US005792240A

United States Patent [19]

Lund

[11] Patent Number: 5,792,240

[45] Date of Patent: Aug. 11, 1998

[54] DEVICE FOR CLEANING ELECTRODES IN AN ELECTROSTATIC PRECIPITATOR AND AN ELECTROSTATIC PRECIPITATOR UTILIZING SUCH DEVICES

[75] Inventor: Carsten Riisberg Lund, Valby, Denmark

[73] Assignees: FLS Miljo A/S, Denmark; Compania Sevillana de Electricidad, Spain

[21] Appl. No.: 681,888

[22] Filed: Jul. 29, 1996

Related U.S. Application Data

[63] Continuation-in-part of Ser. No. 363,281, Dec. 22, 1994, abandoned.

[30] Foreign Application Priority Data

Dec. 23, 1993 [DK] Denmark ..... 1457/93

[51] Int. Cl.[6] ..... B03C 3/76

[52] U.S. Cl. ..... 96/32; 95/76; 310/369

[58] Field of Search ..... 96/32–38, 51; 95/76, 74; 310/328, 369

[56] References Cited

U.S. PATENT DOCUMENTS

| | | | |
|---|---|---|---|
| 2,595,204 | 4/1952 | Richardson | 96/32 |
| 2,922,085 | 1/1960 | Drenning et al. | 96/36 X |
| 3,109,720 | 11/1963 | Cummings et al. | 96/32 X |
| 3,487,606 | 1/1970 | Bridges et al. | 96/32 X |
| 3,504,480 | 4/1970 | Copcutt et al. | 96/36 X |
| 3,844,742 | 10/1974 | Petersen | 96/35 |
| 4,035,165 | 7/1977 | Archer | 96/32 X |
| 4,086,646 | 4/1978 | Lanese | 96/32 X |
| 4,276,056 | 6/1981 | Pasic et al. | 95/76 |
| 4,308,036 | 12/1981 | Zahedi et al. | 96/32 X |
| 4,680,669 | 7/1987 | Tsuchiya et al. | 96/32 X |
| 5,114,442 | 5/1992 | Artz | 96/32 |
| 5,231,325 | 7/1993 | Tamai et al. | 310/328 X |
| 5,366,440 | 11/1994 | Bojsen | 96/33 |

FOREIGN PATENT DOCUMENTS

| | | |
|---|---|---|
| 4210263 | 7/1992 | Japan . |
| 755204 | 8/1956 | United Kingdom . |
| 2138170 | 10/1984 | United Kingdom . |
| WO87/01607 | 3/1987 | WIPO . |

OTHER PUBLICATIONS

Duda, "Cement Data Handbook", Bauverlag GmbH., Wiesbaden and Benlin, 3rd Edition; 1985; pp. 596–598.

*Primary Examiner*—Richard L. Chiesa
*Attorney, Agent, or Firm*—Baker & Botts, L.L.P.

[57] ABSTRACT

The invention relates to a device for rapping electrodes, preferably collecting electrodes, in a high voltage supplied electrostatic precipitator. The device has at least one piezo electric element adapted to supply a rapping impact to at least one electrode at a predetermined level and frequency.

25 Claims, 6 Drawing Sheets

DEVICE FOR CLEANING ELECTRODES IN AN ELECTROSTATIC PRECIPITATOR AND AN ELECTROSTATIC PRECIPITATOR UTILIZING SUCH DEVICES

This application is a continuation-in-part of patent application Ser. No. 08/363,281, which was filed on Dec. 22, 1994 and is now abandoned.

BACKGROUND OF THE INVENTION

The invention relates to a device for cleaning electrodes, preferably collecting electrodes, of a high-voltage supplied electrostatic precipitator comprising a precipitator housing and a suspension arrangement for the electrodes mounted in the precipitator housing.

The invention further relates to an electrostatic precipitator utilizing such devices. Such precipitators are used for cleaning smoke gasses from the combustion of fossil fuels, waste materials and the like in for instance power supply plants, combustion plants or cement plants.

Due to the operation mode of such precipitators dust is deposited on the electrodes and in particular on the collecting electrodes during the operation. This is well known in the art. In order to ensure the efficiency of the precipitator these electrodes need to be regularly cleaned of the deposited dust. This is normally effected by rapping or vibrating the electrodes.

The impact required for rapping or vibrating the electrodes is usually produced by a number of hammers being lifted by a rotating shaft extending across the precipitator width from their vertically suspended position and subsequently being released so as to revert to their vertical position. For each hammer an impact rod or an impact beam is provided which is hit by the hammer when the latter reverts to its vertical position and from the impact rod/beam the supplied impact energy is transmitted to a section of precipitator electrodes.

The collecting electrodes usually consist of vertically suspended, narrow and substantially rectangular plates which at their upper ends are secured to a suspension device in a precipitator housing containing the electrodes. The latter may be mounted in mutually parallel rows or precipitator sections, and the rapping is effected for the separate sections by means of drop hammers and impact rods for each section. Rapping devices of this type are known, e.g. from Duda: "Cement Data Handbook", 3rd. edition, pp. 596–598 (Bauverlag Gmbh—Wiesbaden und Berlin 1985) and from patent publications Nos; U.S. Pat. No. 3,844,742 and GB-A-2,138,170.

In the so-called European type electrostatic precipitators drop hammers and impact rods connected to the lower ends of the collecting electrodes are generally used, which is associated with the drawback that the hammers and their carrier bridges occupy comparatively much space at the end of and below the precipitator section which, in turn, requires an increased length and height of the surrounding precipitator housing.

In the so-called American type electrostatic precipitators the rapping of the electrodes is often effected from the top of the precipitator, the rapping device then being mounted externally on top of the precipitator housing and the rapping being effected by means of small, vertically mounted impact rods which hit the electrode suspension vertically. In that case the individual impact rod is provided with slide sealings around the passage through the precipitator housing roof. Certain precipitators of the American type may alternatively be provided with a vertically acting rapping device mounted inside the precipitator housing which actuates the electrodes axially. In the American-type precipitators having the rapping device mounted on top of the precipitator housing roof, the volume occupied by the aggregate precipitator in the plant concerned is also substantially increased.

In addition to the drawbacks mentioned in connection with the European and American type precipitators, respectively, both precipitator types suffer from the drawback that it is difficult to control the rapping level and rapping frequency. Prior art rapping devices do not provide the possibility of controlling the rapping level during operation, and changes, if any, of the electrostatic precipitator generally necessitate considerable changes of the rapping device.

SUMMARY OF THE INVENTION

It is therefore the object of the invention to provide a device for cleaning electrodes in an electrostatic precipitator and an electrostatic precipitator utilizing such devices, by which the above mentioned drawbacks as to precipitator size and rapping control is substantially remedied.

This object is obtained with a device which comprises at least one piezo electric element adapted to supply a rapping impact to at least one electrode, said piezo electric element being connected to a voltage source enabling it to supply an impact of a predetermined level and frequency.

Thus, a rapping device is provided which can be used both in connection with precipitators in which the collecting electrodes are suspended eccentrically and in precipitators in which the collecting electrodes are secured by bolts, by which the drawbacks in the form of extensive space requirements and necessary comprehensive mechanical changes in the optimization of the cleaning efficiency at different operating states for the electrostatic precipitator are remedied, as it in connection with suitable voltage and frequency control means provides the possibility of controlling the excitation level and impact frequency.

Several piezo electric elements may advantageously be coupled together to form a piezo electric actuator constituting a rapping device.

Such an actuator may advantageously comprise a number of piezo electric elements which are series connected in their expansion direction and have the form of discs, which piezo electric elements are mutually separated by electrically conducting connection discs and are electrically parallel connected, every second electrically conducting connection disc being connected with the same phase of an applied alternating voltage.

It is thus possible for one or several mutually independent piezo electric elements to form rapping devices in an electrostatic precipitator according to the invention, in which the rapping device(s) is/are mounted in the precipitator in a manner so as to apply impact or vibration force to at least one electrode when a voltage differential is applied from the voltage field.

An actuator may similarly be caused to actuate several electrodes or electrode sections.

In the hitherto known rapping devices each individual hammer vibrates several electrodes or an entire electrode section and thus there is no possibility of actuating individual electrodes separately. Hence, the electrode in the impact actuated section proximal to the hammer receives the highest amount of energy, whereas the electrode distal to the hammer receives the lowest amount of energy.

Consequently, in an electrostatic precipitator according to the invention a rapping device consisting of a piezo electric element or a piezo electric actuator is particularly advantageously mounted in such a manner that the impact actuation is only applied to one electrode when a voltage differential is applied to the actuator. This means that each electrode should be provided with one or more rapping devices and it is thereby ensured that the individual electrode is actuated uniformly and in the manner most effective for the cleaning.

In a preferred embodiment of the electrostatic precipitator according to the invention the individual piezo electric actuator is secured particularly expediently in a manner so that the impact actuation from the actuator is effected in the longitudinal direction of the collecting electrode. This ensures a satisfactory energy transmission in the electrode for all frequencies as the actuation with push and pull forces in the longitudinal direction of the electrode is substantially frequency independent as opposed to bending oscillations which are heavily frequency dependent. In case the actuator was mounted transversely to the longitudinal direction of the electrode a considerable portion of the energy transmission in the longitudinal direction of the electrode would be effected in the form of bending oscillations, which is not optimum.

In a preferred embodiment of the precipitator according to the invention two piezo electric actuators are mounted on each electrode. A symmetrical wave propagation is thereby obtained which further improves the energy transmission.

The piezo electric actuators may be expediently mounted in an edge bending on a plate shaped collecting electrode. This is desired partly in order to prevent the actuator from interfering in the precipitator function if mounted in the active volume of the precipitator, partly to ensure that the actuator is not damaged in case of flashovers in the precipitator, and partly to shield the actuator against the high voltage fields present in the precipitator, which may affect the function of the actuator. Thus, the shield formed serves as a Faraday-cage. Besides, the mounting of the actuator in the edge bending of a plate electrode is advantageous, as this portion of the electrode has an increased material stiffness and as a result thereof will provide a satisfactory energy transmission from the actuator.

In a preferred embodiment the precipitator according to the invention is provided with means for controlling said voltage application from the area outside the electrostatic precipitator.

In another preferred embodiment of the precipitator according to the invention means for adjusting the voltage level and thereby regulating the force by which the actuator actuates the electrode(s) are provided.

In a still further preferred embodiment the precipitator is provided with means for adjusting the frequency of the voltage applied. The voltage level and the frequency may advantageously be adjustable simultaneously or independently in order to make the cleaning of the electrode efficient.

BRIEF DESCRIPTION OF THE DRAWINGS

A preferred embodiment of the device according to the invention is further explained below with reference to the drawings wherein.

DESCRIPTION OF THE PREFERRED EMBODIMENTS

Piezo electric elements are formed from materials, often crystalline materials, which are made piezo electric by a polarization. This means that the di-poles present in the materials are paralleled by being exposed to a direct voltage field and usually at an elevated temperature. When a voltage differential is subsequently applied to such a piezo electric element mechanical tensions will be generated in the material which as a result thereof will change form. The extent of the generated tensions in the material is proportional to the voltage applied at different voltage ranges.

Figure 1:
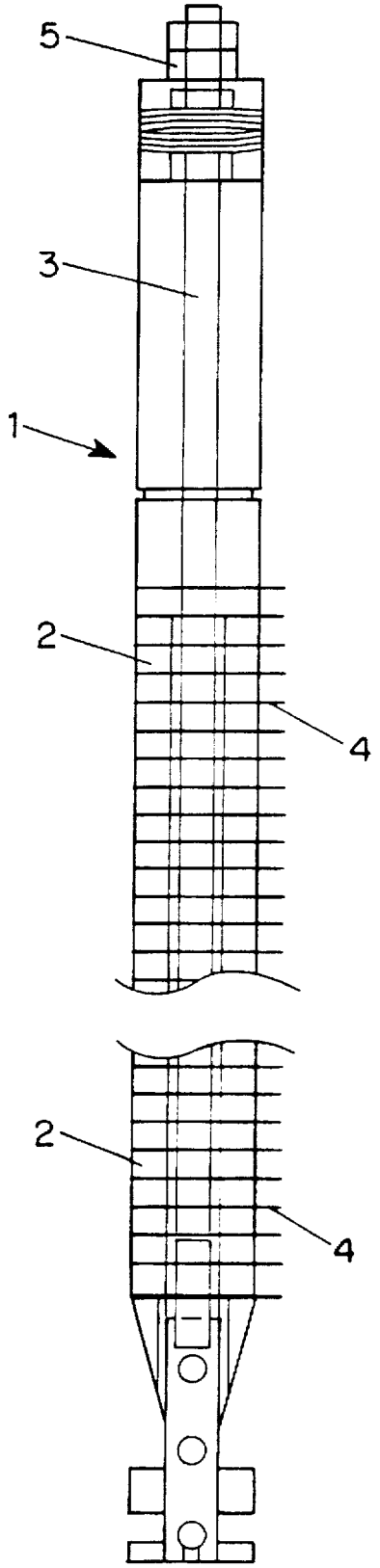
FIG. 1 shows an actuator produced of piezo electric elements seen from the side and from the end.
Figure 2:
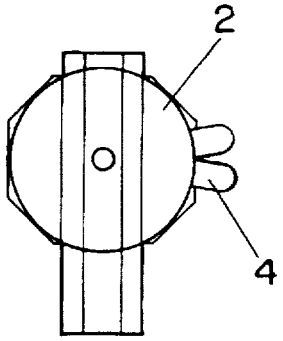
FIG. 2 shows the actuator of FIG. 1 seen from the end.

It appears from FIGS. 1 and 2 that the actuator 1 comprises a number of piezo electric elements 2 having the form of cylindrical discs mounted in series on a central bolt 3, the discs being mutually separated by a thin metal disc 4. The piezo electric elements and the discs between them are prestressed to a predetermined force by clamping means 5 and spring means. Every second piezo electric element is connected to the same phase of an applied alternating voltage and as a result thereof the elements 2 are electrically parallel connected through the discs 4.

Figure 3:
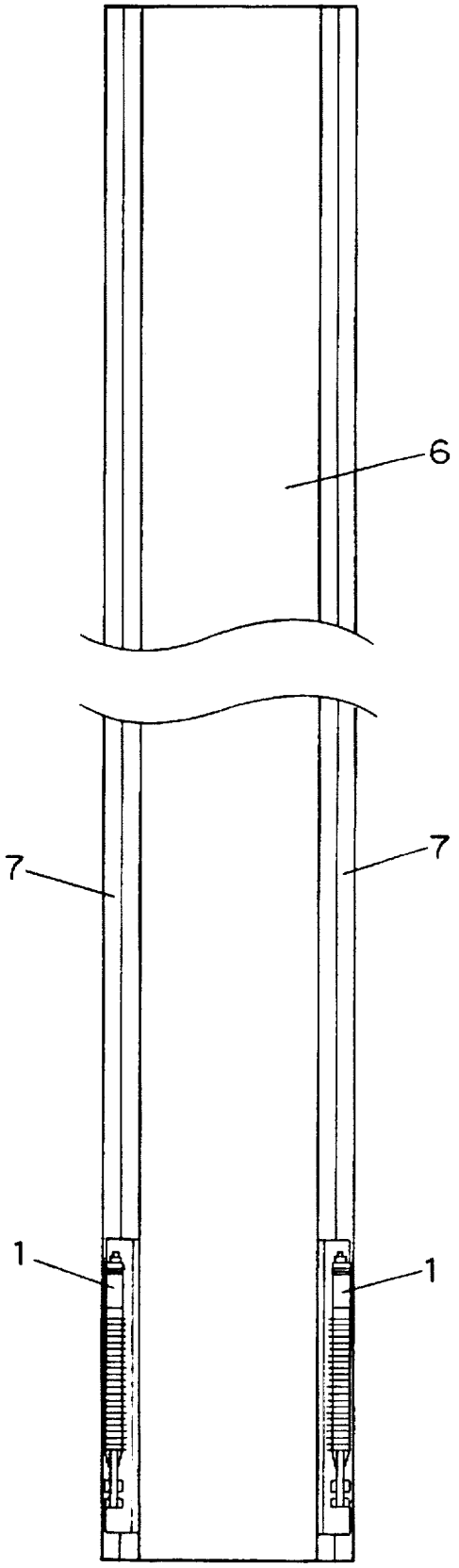
FIG. 3 shows a plate shaped collecting electrode with two actuators of the type shown in FIGS. 1 and 2 mounted on its sides.

FIG. 3 shows how two actuators of the type shown in FIG. 1 are mounted in the bended side edges 7 of a plate shaped collecting electrode 6 so that the axis of the rodshaped actuator 1 extends parallel with the longitudinal direction of the plate electrode. As each actuator 1 e.g. is secured at its ends with bolts, the actuators actuate the electrodes in the longitudinal direction when a voltage differential is applied on the actuator.

As mentioned above a voltage differential is applied to the piezo electric actuators thereby causing the piezo electric elements to be expanded or contracted and hence the electrode is exposed to an impact. Thus, the electrode may be subject to a push and pull force. The extent of the expansion of the piezo electric elements can be controlled by adjustment of the applied voltage and likewise the frequency of the impact can be controlled by adjustment of the frequency of applied voltage. For this purpose means for voltage adjustment and frequency adjustment are provided. These adjustment means are commonly known. Thus, the rapping force and rapping frequency can be adjusted outside the precipitator to the level needed at any time without any demanding reconstruction of the precipitator.

Figure 4:
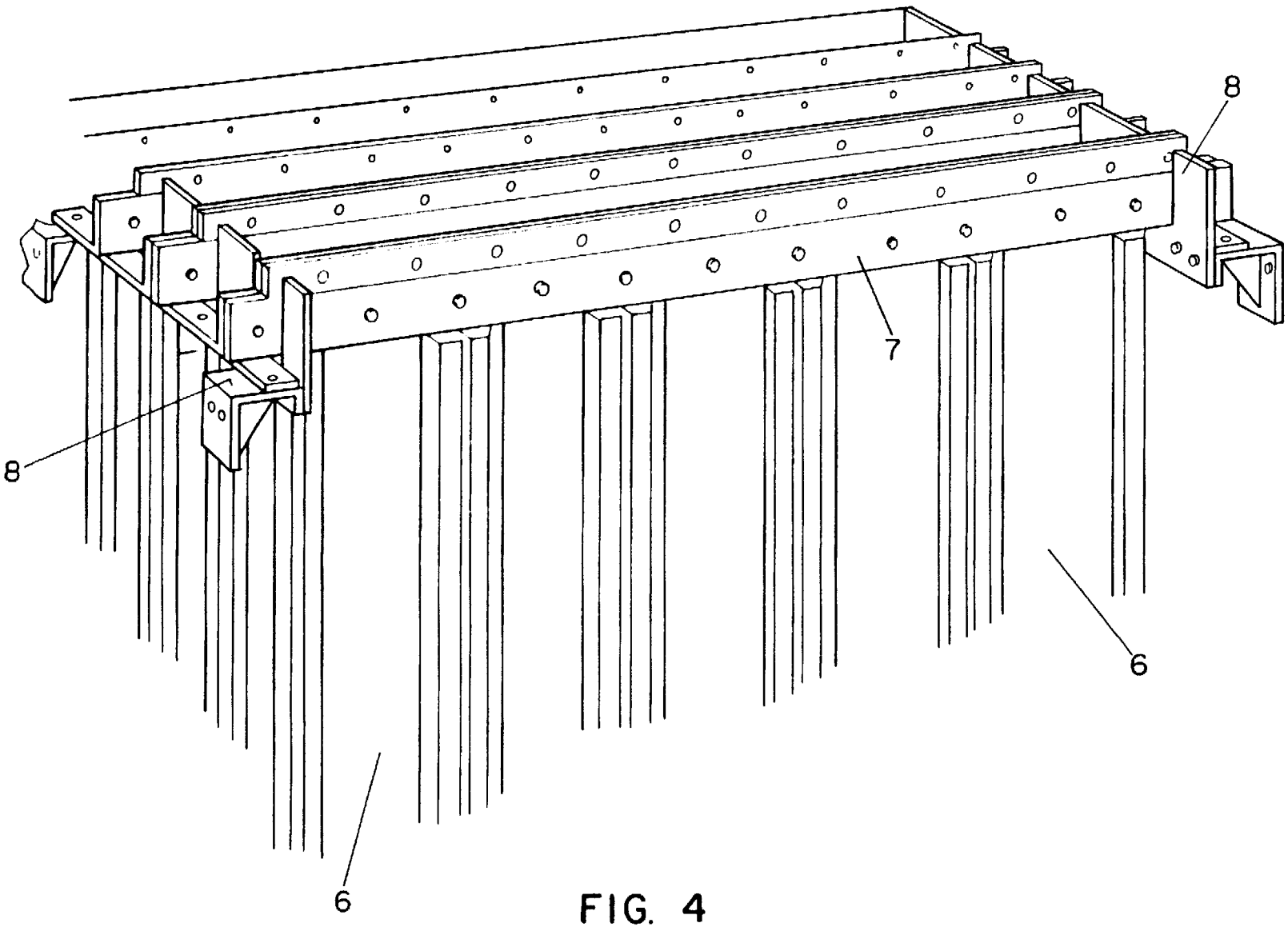
FIG. 4 shows by way of example a suspension arrangement for collecting electrodes.

As shown in FIG. 4 the electrodes 6 are suspended vertically from a suspension arrangement comprising beam elements 7 to which the electrodes are secured, and which are supported at their ends by supporting elements 8 secured to the precipitator housing. This will not be further explained at this point as it is not important for the invention. However, a similar construction is described in connection with another rapping device in U.S. Pat. No. 5,366,540.

Figure 5:
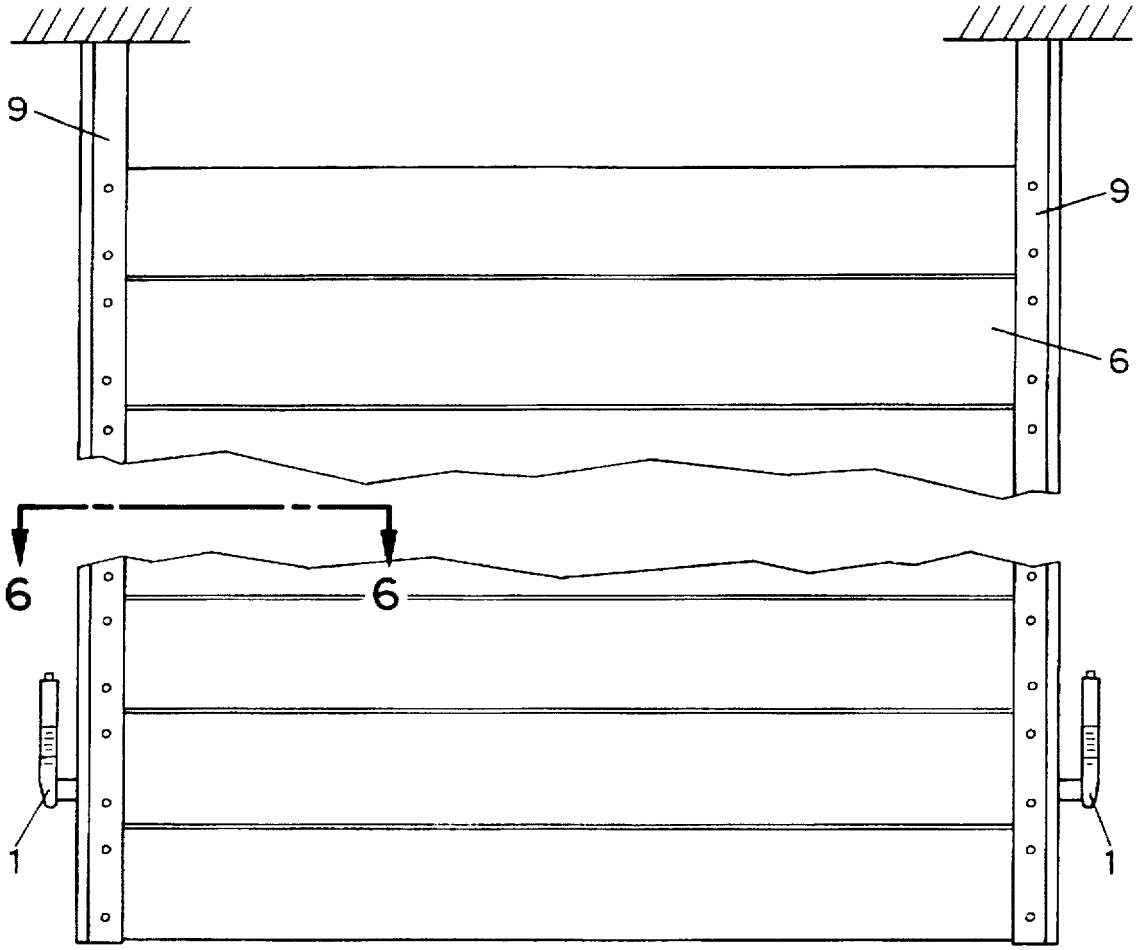
FIG. 5 shows a second example of a suspension arrangement for collecting electrodes.

The suspension arrangement shown in FIG. 5 includes vertical suspension elements which at their uppermost ends are secured to a filter housing. The collecting electrodes 6 are arranged horizontally between two such suspension elements. On each of the suspension elements a rapping device in the form of a piezo element actuator is arranged.

Figure 6:
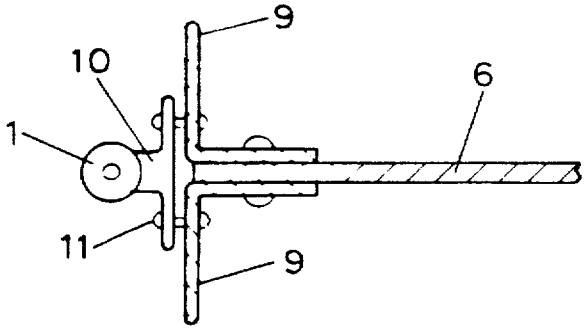
FIG. 6 is a sectional view after the line A—A of a part of the arrangement from FIG. 5.

From FIG. 6 it is clear that each suspension element is constituted by two L-shaped bars 9 where the collecting electrodes 6 at their ends are fastened between the two bars. A bracket 10 for connecting the piezo electric actuator 1 to the bars 9 is secured to the bars by means of holding elements 11.

Figure 7:
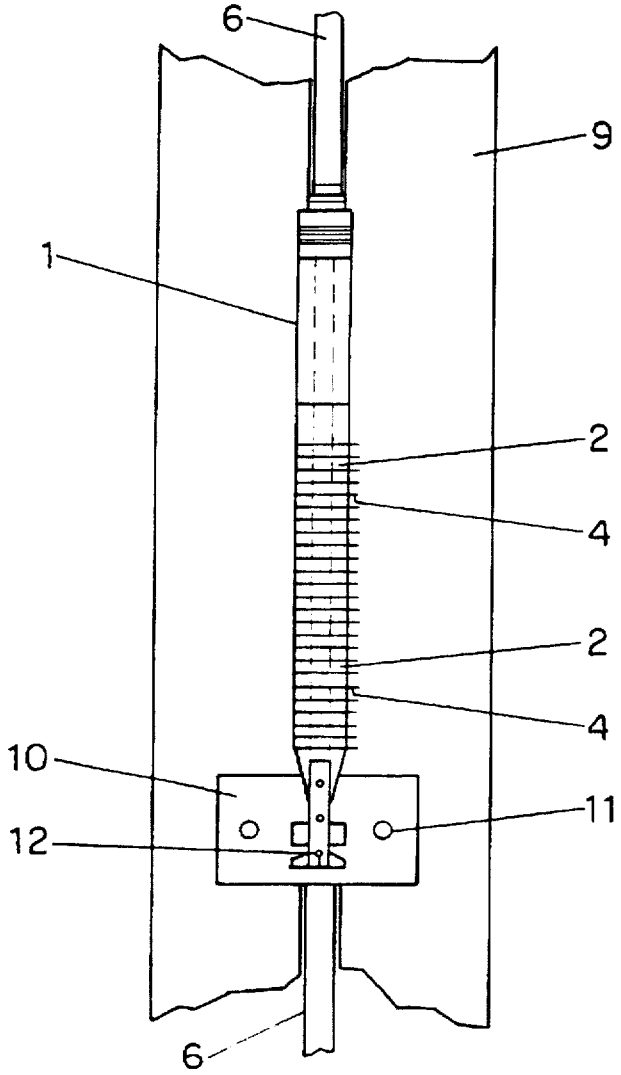
FIG. 7 is an end view of a part of the arrangement from FIG. 5.

From FIG. 7 it further appears that the piezo electric actuator 1 is secured to the bracket 10 by means of holding elements 12. The piezo electric actuator is identical to the actuator shown in FIG. 1.

Figure 8:
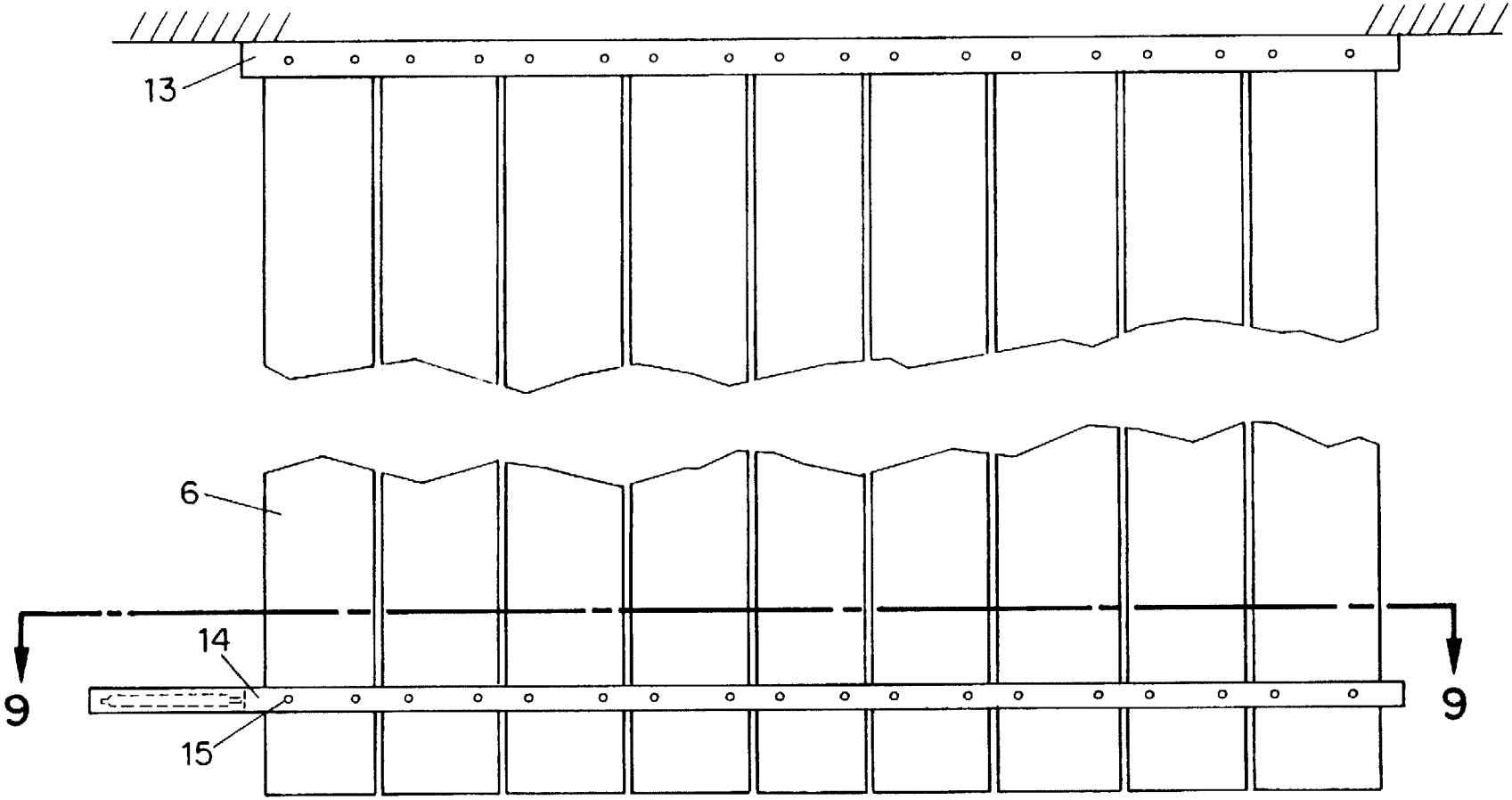
FIG. 8 shows a third example of a suspension arrangement for collecting electrodes incorporating an impact rod.

The suspension arrangement shown in FIG. 8 includes a horizontal suspension bar 13 secured to a filter housing. The collecting electrodes 6 are at their uppermost ends suspended from the bar 13. At the lower end of the collecting electrodes an impact rod 14 is secured to the collecting electrodes by means of holding elements 15.

Figure 9:
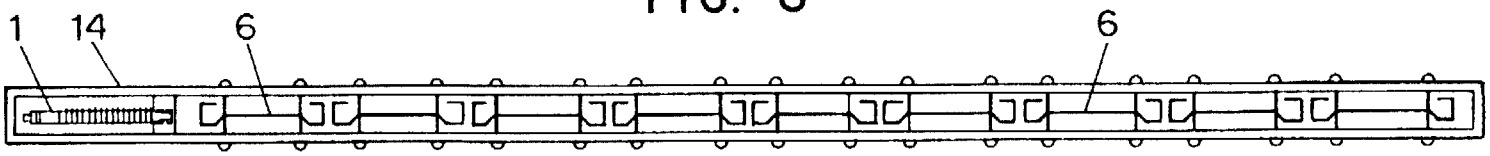
FIG. 9 is a sectional view after the line B—B in FIG. 8.

From FIG. 9 it appears that a rapping device in the form of a piezo electric actuator 1 is secured to the impact rod 14. It further appears that the impact rod 14 surrounds the collecting electrodes 6.

Figure 10:
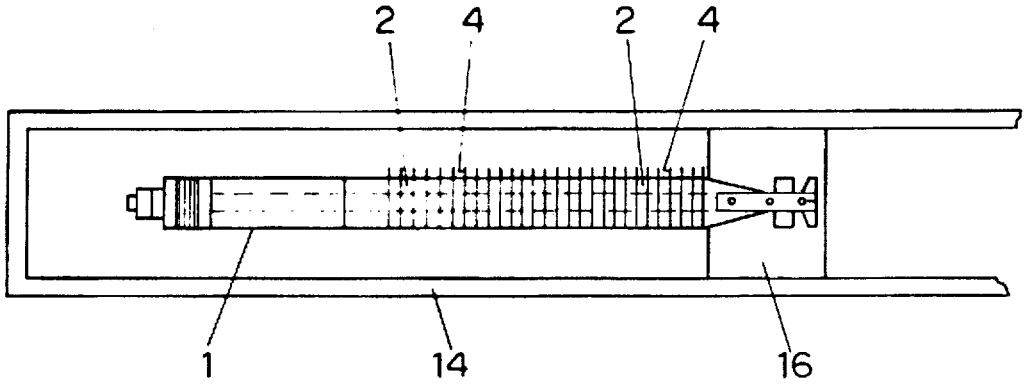
FIG. 10 shows enlarged the arrangement of the piezo electric rapping device in the impact rod shown in FIG. 8.

FIG. 10 shows an enlarged view of an end portion of the impact rod 14 where the piezo electric actuator is secured to a transverse plate element 16 between two opposed walls of the impact rod 14.

I claim:

1. An electrostatic precipitator comprising a housing, a suspension arrangement in the housing, discharge and collecting electrodes suspended in said arrangement and at least one rapping device for rapping of at least one collecting electrode, and wherein said at least one rapping device comprises a plurality of piezo electric disc elements mounted in series and mutually separated by electrically conducting connection discs, the piezo electric disc elements and the electrically conducting discs being coupled together so as to form a piezo electric actuator, said piezo electric actuator being connected to a voltage source in such a manner that every second electrically conducting disc is connected to the same phase of the voltage source so as to apply a sufficiently large impact or vibration force to said at least one collecting electrode by the piezo electric actuator when a voltage differential is applied from the voltage source.

2. An electrostatic precipitator according to claim 1, wherein said electrically conducting connection discs are electrically parallel connected, every second electrically conducting connection disc being connected with the same phase of an applied alternating voltage.

3. An electrostatic precipitator according to claim 1, wherein the rapping device is mounted in such a manner that a plurality of electrodes are rapped simultaneously when a voltage differential is applied to the device.

4. An electrostatic precipitator according to claim 1, wherein at least one piezo electric actuator is secured to an electrode to provide an impact substantially in the longitudinal direction of the electrode.

5. An electrostatic precipitator according to claim 4 comprising two actuators mounted on each separate electrode.

6. An electrostatic precipitator according to claim 5 including means for controlling the electric voltage differential from the area outside the electrostatic precipitator.

7. An electrostatic precipitator according to claim 5 including means for adjusting the voltage difference and thereby the excitation level of the rapping device.

8. An electrostatic precipitator according to claim 5 including means for adjusting the frequency of the applied voltage differential and thereby the oscillation frequency of the rapping device to the operating state of the electrostatic precipitator.

9. An electrostatic precipitator according to claim 5, wherein each actuator is positioned into and secured to an edge bending of a plate electrode.

10. An electrostatic precipitator according to claim 9 comprising two actuators mounted on each separate electrode.

11. An electrostatic precipitator according to claim 9 including means for controlling the electric voltage differential from the area outside the electrostatic precipitator.

12. An electrostatic precipitator according to claim 9 including means for adjusting the voltage difference and thereby the excitation level of the rapping device.

13. An electrostatic precipitator according to claim 9 including means for adjusting the frequency of the applied voltage differential and thereby the oscillation frequency of the rapping device to the operating state of the electrostatic precipitator.

14. An electrostatic precipitator according to claim 1, including means for controlling the electric voltage differential from the area outside the electrostatic precipitator.

15. An electrostatic precipitator according to claim 14 wherein each actuator is positioned into and secured to an edge bending of a plate electrode.

16. An electrostatic precipitator according to claim 14 including means for adjusting the voltage difference and thereby the excitation level of the rapping device.

17. An electrostatic precipitator according to claim 14 including means for adjusting the frequency of the applied voltage differential and thereby the oscillation frequency of the rapping device to the operating state of the electrostatic precipitator.

18. A precipitator according to claim 1, including means for adjusting the voltage differential and thereby the excitation level of the rapping device.

19. An electrostatic precipitator according to claim 18 including means for controlling the electric voltage differential from the area outside the electrostatic precipitator.

20. An electrostatic precipitator according to claim 18 including means for adjusting the frequency of the applied voltage differential and thereby the oscillation frequency of the rapping device to the operating state of the electrostatic precipitator.

21. An electrostatic precipitator according to claim 1, including means for adjusting the frequency of the applied voltage differential and thereby the oscillation frequency of the rapping device to the operating state of the electrostatic precipitator.

22. An electrostatic precipitator according to claim 1, wherein the at least one collecting electrode is arranged horizontally between two suspension elements, said suspension elements being secured to the housing.

23. An electrostatic precipitator according to claim 22, wherein each of the suspension elements comprises two L-shaped bars, and wherein the collecting electrode is fastened between said bars.

24. An electrostatic precipitator according to claim 1, wherein the at least one collecting electrode is suspended from a horizontal suspension bar secured to said housing, and wherein said rapping device includes an impact rod coupled to the piezo electric actuator, said impact rod being secured to a lower end of the collecting electrode.

25. An electrostatic precipitator according to claim 24, wherein the impact rod surrounds the collecting electrode.

* * * * *